US008381569B2

(12) United States Patent
Lilie et al.

(10) Patent No.: US 8,381,569 B2
(45) **Date of Patent: *Feb. 26, 2013**

(54) METHOD AND APPARATUS FOR DETERMINING LOAD AMOUNT IN A LAUNDRY TREATING APPLIANCE

(75) Inventors: Dietmar E. Lilie, Joinville (BR); Rodrigo S. Teixeira, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 296 days.

This patent is subject to a terminal disclaimer.

(21) Appl. No.: 12/620,089

(22) Filed: Nov. 17, 2009

(65) Prior Publication Data

US 2011/0113902 A1 May 19, 2011

(51) Int. Cl.
*G01P 21/00* (2006.01)
*D06F 33/00* (2006.01)

(52) U.S. Cl. ..... 73/1.37; 73/865.8; 73/865.3; 68/12.04; 68/12.02; 68/12.01

(58) Field of Classification Search ..... 73/865.8, 73/865.3; 68/12.04; 248/608, 664, 666
See application file for complete search history.

(56) References Cited

U.S. PATENT DOCUMENTS

| | | | | |
|---|---|---|---|---|
| 5,442,960 | A * | 8/1995 | Solberg, Jr. | 73/580 |
| 5,507,055 | A | 4/1996 | Blauert et al. | |
| 5,900,590 | A * | 5/1999 | Solberg et al. | 177/1 |
| 5,902,964 | A * | 5/1999 | Solberg et al. | 177/1 |
| 6,374,444 | B2 | 4/2002 | Skrippek et al. | |
| 7,325,422 | B2 | 2/2008 | Seo et al. | |
| 8,186,227 | B2 * | 5/2012 | Ashrafzadeh | 73/760 |
| 2007/0182264 | A1 * | 8/2007 | Jun et al. | 310/156.38 |
| 2011/0030460 | A1 * | 2/2011 | Ashrafzadeh | 73/65.01 |

FOREIGN PATENT DOCUMENTS

| | | | |
|---|---|---|---|
| EP | 0410827 | A1 | 1/1991 |
| GB | 2247250 | A | 2/1992 |
| WO | 03/046271 | A1 | 6/2003 |
| WO | 2008/053002 | A2 | 5/2008 |
| WO | WO 2008053002 | A2 * | 5/2008 |

* cited by examiner

*Primary Examiner* — Lisa Caputo
*Assistant Examiner* — Roger Hernandez-Prewitt
(74) *Attorney, Agent, or Firm* — Clifton G. Green; McGarry Bair PC

(57) ABSTRACT

A method for determining the amount of laundry in a laundry treating appliance comprises a drum defining a treating chamber for receiving the laundry and a motor for rotating the drum that may be operated to simulate a spring to oscillate the drum relative to a predetermined rotational position. The angular decay of the drum relative to the predetermined position may be determined and used to determine the amount of laundry.

16 Claims, 6 Drawing Sheets

METHOD AND APPARATUS FOR DETERMINING LOAD AMOUNT IN A LAUNDRY TREATING APPLIANCE

BACKGROUND OF THE INVENTION

Laundry treating appliances, such as clothes washers, refreshers, and non-aqueous systems, may have a configuration based on a rotating drum that defines a treating chamber in which laundry items are placed for treating. The laundry treating appliance may have a controller that implements a number of pre-programmed cycles of operation having one or more operating parameters. The controller may automatically determine the load amount in the treating chamber and use the determined load amount to set one or more operating parameters.

BRIEF DESCRIPTION OF THE INVENTION

A method for determining the amount of laundry in a laundry treating appliance comprises a drum defining a treating chamber for receiving the laundry and a motor for rotating the drum that may be operated to simulate a spring to oscillate the drum relative to a predetermined rotational position. The angular decay of the drum relative to the predetermined position may be determined and used to determine the amount of laundry.

DESCRIPTION OF AN EMBODIMENT OF THE INVENTION

Figure 1:
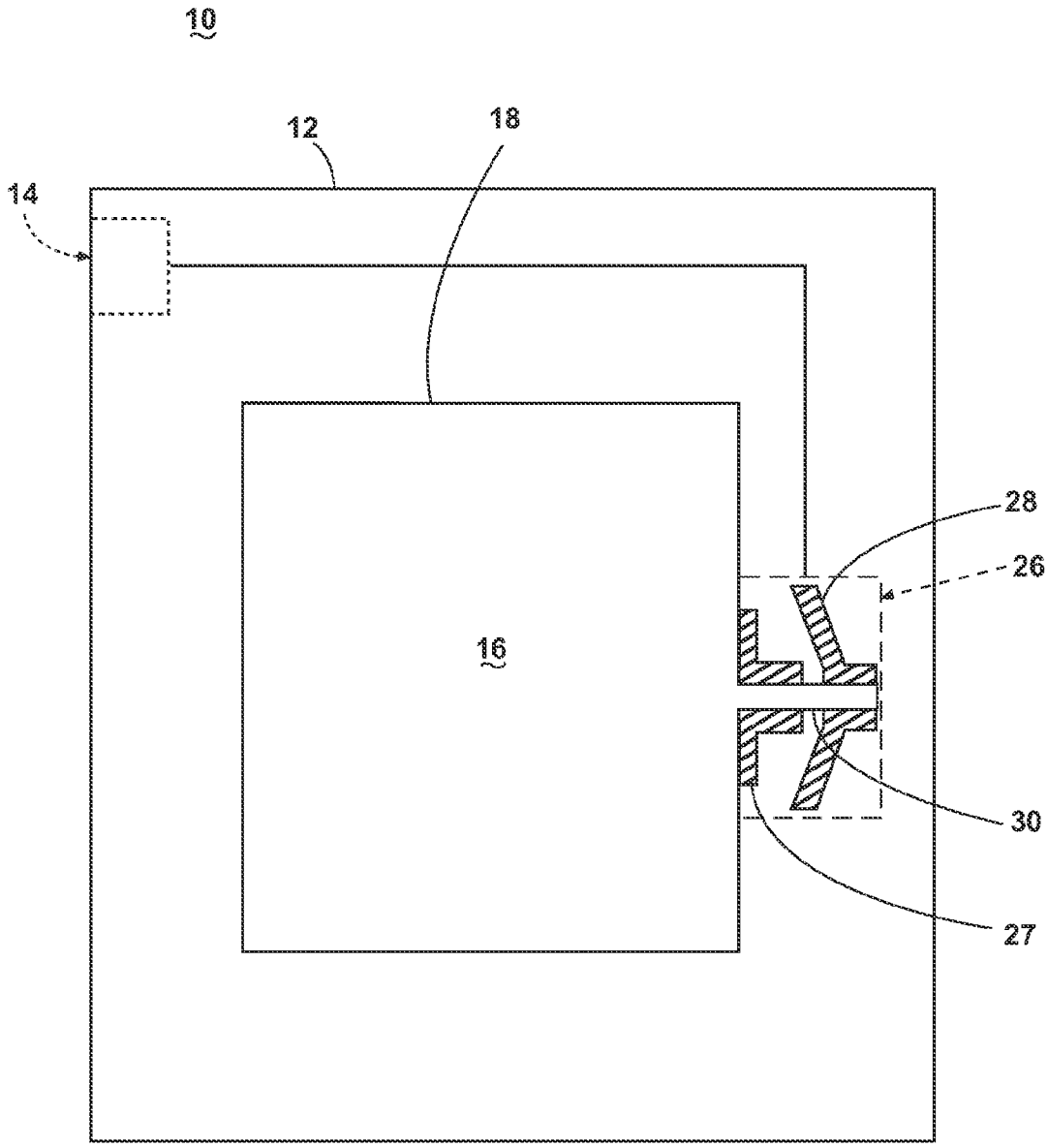
FIG. 1 is a schematic view of a laundry treating appliance according to a first embodiment of the invention.

FIG. 1 illustrates one embodiment of a laundry treating appliance according to the invention. The laundry treating appliance 10 according to the invention may be any appliance which performs a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance 10 may include a cabinet 12 having a controller 14 for controlling the operation of the laundry treating appliance 10 to complete a cycle of operation. A treating chamber 16 may be defined by a rotatable drum 18 located within the cabinet 12 for receiving laundry to be treated during a cycle of operation. The drum 18 may be coupled with a motor 26 having a stator 27 and a rotor 28 through a drive shaft 30 for selective rotation of the treating chamber 16 during a cycle of operation.

The controller 14 may be operably coupled with the motor 26 of the laundry treating appliance 10 for communicating with and controlling the operation of the motor 26 to complete a cycle of operation. The controller 14 may contain a motor driving algorithm for driving the drum 18 to oscillate about a predetermined position. The motor 26 may send information to the controller 14 relating to the angular position of the drum 18 over time as it is oscillated about the predetermined position. The controller 14 may use the angular position information to determine the amount of the laundry load in the treating chamber 16.

Figure 2:
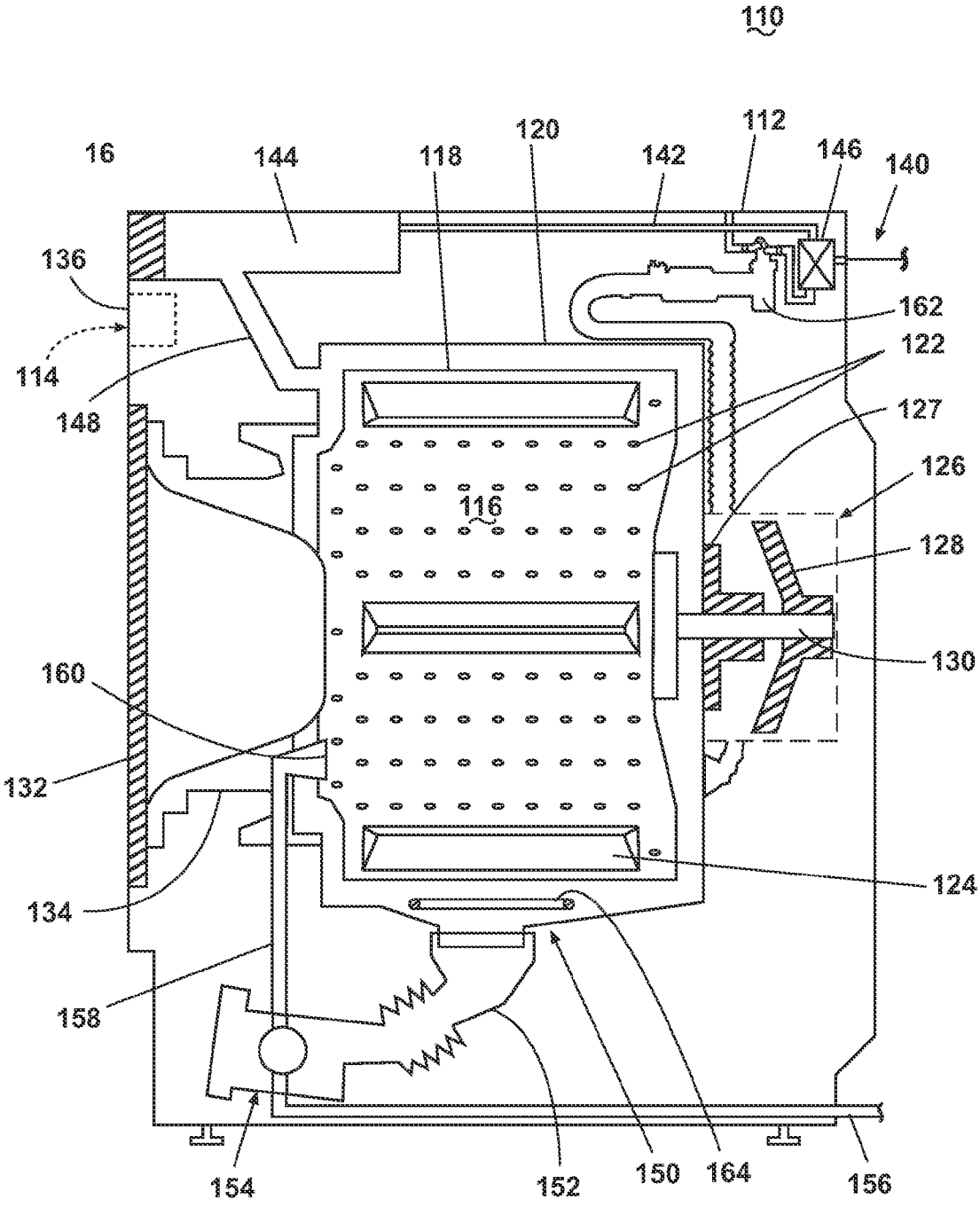
FIG. 2 is a schematic view of a laundry treating appliance according to a second embodiment of the invention.

FIG. 2 illustrates a second embodiment of the invention in the form of a washing machine 110 which is similar in structure to the laundry treating appliance 10. Therefore, elements in the washing machine 110 similar to the laundry treating appliance 10 will be numbered with the prefix 100. The washing machine 110 described herein shares many features of a traditional automatic washing machine, which will not be described in detail except as necessary for a complete understanding of the invention.

FIG. 2 provides a schematic view of the washing machine 110 that may include a cabinet 112 having a controller 114 for controlling the operation of the washing machine 110 to complete a cycle of operation. A treating chamber 116 may be defined by a rotatable drum 118 located within the cabinet 112 for receiving laundry to be treated during a cycle of operation. The rotatable drum 118 may be mounted within a tub 120 and may include a plurality of perforations 122, such that liquid may flow between the tub 120 and the drum 118 through the perforations 122.

The drum 118 may further include a plurality of baffles 124 disposed on an inner surface of the drum 118 to lift the laundry load contained in the laundry treating chamber 116 while the drum 118 rotates. A motor 126 may be directly coupled with the drive shaft 130 to rotate the drum 118. The motor 126 may be a brushless permanent magnet (BPM) motor having a stator 127 and a rotor 128. Alternately, the motor 126 may be coupled to the drum 118 through a belt and a drive shaft to rotate the drum 118, as is known in the art. Other motors, such as an induction motor or a permanent split capacitor (PSC) motor, may also be used. The motor 126 may rotate the drum 118 at various speeds in either rotational direction.

Both the tub 120 and the drum 118 may be selectively closed by a door 132. A bellows 134 couples an open face of the tub 120 with the cabinet 112, and the door 132 seals against the bellows 134 when the door 132 closes the tub 120. The cabinet 112 may also include a user interface 136 that may include one or more knobs, switches, displays, and the like for communicating with the user, such as to receive input and provide output.

While the illustrated washing machine 110 includes both the tub 120 and the drum 118, with the drum 118 defining the laundry treating chamber 116, it is within the scope of the invention for the washing machine 110 to include only one receptacle, with the receptacle defining the laundry treating chamber for receiving the laundry load to be treated.

The washing machine 110 of FIG. 2 may further include a liquid supply and recirculation system. Liquid, such as water, may be supplied to the washing machine 110 from a water supply 140, such as a household water supply. A supply conduit 142 may fluidly couple the water supply 140 to the tub 120 and a treatment dispenser 144. The supply conduit 142 may be provided with an inlet valve 146 for controlling the flow of liquid from the water supply 140 through the supply conduit 142 to either the tub 120 or the treatment dispenser 144.

A liquid conduit 148 may fluidly couple the treatment dispenser 144 with the tub 120. The liquid conduit 148 may couple with the tub 120 at any suitable location on the tub 120 and is shown as being coupled to a front wall of the tub 120 in FIG. 2 for exemplary purposes. The liquid that flows from the treatment dispenser 144 through the liquid conduit 148 to the tub 120 typically enters a space between the tub 120 and the drum 118 and may flow by gravity to a sump 150 formed in part by a lower portion of the tub 120. The sump 150 may also be formed by a sump conduit 152 that may fluidly couple the lower portion of the tub 120 to a pump 154. The pump 154 may direct fluid to a drain conduit 156, which may drain the liquid from the washing machine 110, or to a recirculation conduit 158, which may terminate at a recirculation inlet 160. The recirculation inlet 160 may direct the liquid from the recirculation conduit 158 into the drum 118. The recirculation inlet 160 may introduce the liquid into the drum 118 in any suitable manner, such as by spraying, dripping, or providing a steady flow of the liquid.

The liquid supply and recirculation system may further include one or more devices for heating the liquid such as a steam generator 162 and/or a sump heater 164.

The steam generator 162 may be provided to supply steam to the treating chamber 116, either directly into the drum 118 or indirectly through the tub 120 as illustrated. The valve 146 may also be used to control the supply of water to the steam generator 162. The steam generator 162 is illustrated as a flow through steam generator, but may be other types, including a tank type steam generator. Alternatively, the heating element 164 may be used to generate steam in place of or in addition to the steam generator 162. The steam generator 162 may be controlled by the controller 114 and may be used to heat to the laundry as part of a cycle of operation, much in the same manner as heating element 164. The steam generator 162 may also be used to introduce steam to treat the laundry as compared to merely heating the laundry.

Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 110 and for the introduction of more than one type of detergent/wash aid. Further, the liquid supply and recirculation system need not include the recirculation portion of the system or may include other types of recirculation systems.

Figure 3:
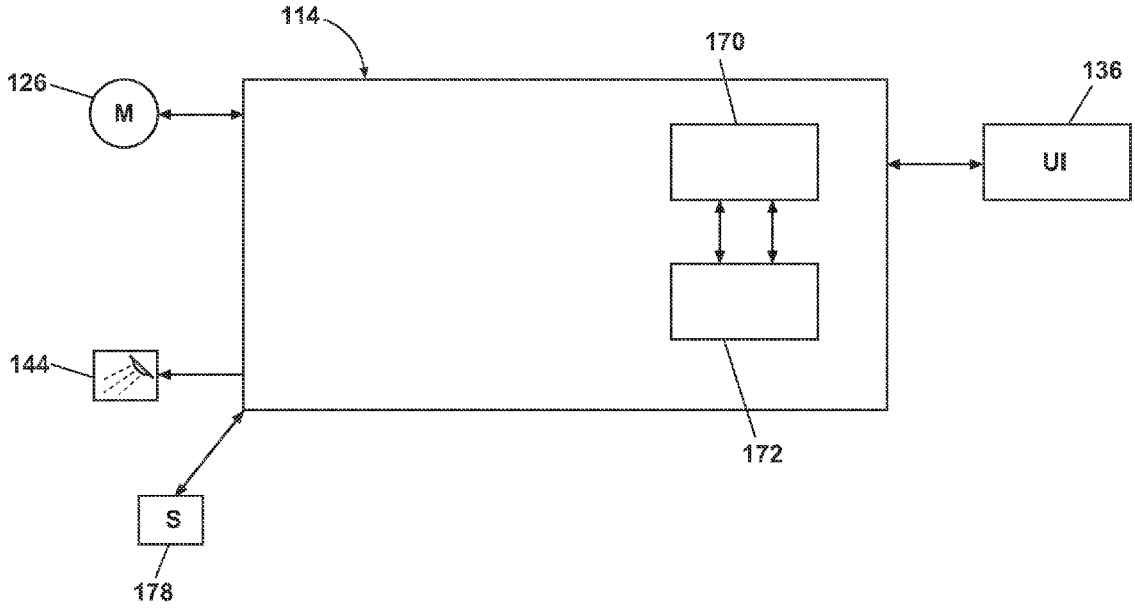
FIG. 3 is a schematic view of a control system of the laundry treating appliance of FIG. 2 according to the second embodiment.

As illustrated in FIG. 3, the controller 114 may be provided with a memory 170 and a central processing unit (CPU) 172. The memory 170 may be used for storing the control software that is executed by the CPU 172 in completing a cycle of operation using the washing machine 110 and any additional software. The memory 170 may also be used to store information, such as a database or table, and to store data received from one or more components of the washing machine 110 that may be communicably coupled with the controller 114.

The controller 114 may be operably coupled with one or more components of the washing machine 110 for communicating with and controlling the operation of the component to complete a cycle of operation. For example, the controller 114 may be coupled with the motor 126 for controlling the direction and speed of rotation of the drum 118 and the treatment dispenser 144 for dispensing a treatment during a cycle of operation. The controller 114 may also be coupled with the user interface 136 for receiving user selected inputs and communicating information to the user.

The controller 114 may also receive input from one or more sensors 178, which are known in the art and not shown for simplicity. Non-limiting examples of sensors 178 that may by communicably coupled with the controller 114 include: a treating chamber temperature sensor, a moisture sensor, a weight sensor, a position sensor and a motor torque sensor.

The controller 114 may be operably coupled with the motor 126 to control the motor 126 to oscillate the drum 118 about a predetermined position to simulate a spring. That is, the motor is used to rotate the drum as if the motor were a spring, such as a linear spring, which can be modeled based on the equation for the force F exerted by a spring when it is compressed or stressed according to $F=-kx$ for a linear spring or according to the torque $\tau$ exerted by a spring when twisted from its equilibrium position according to $\tau=-k\theta$ for a torsional spring, where k is the spring constant and x and $\theta$ are the linear and angular displacement from the equilibrium position, respectively. A motor control algorithm may be stored in the memory 170 of the controller 114 and executed by the CPU 172 for controlling the motor 126 to oscillate the drum 118 to simulate a spring. The controller 114 may also be coupled with the motor 126 to receive information from the motor 126 that may be used to determine the angular position of the drum 118 as it is oscillated about the predetermined position. The controller 114 may store the angular position information in its memory 170 for analysis using software that may also be stored in the memory 170 to determine the amount of laundry present within the drum 118.

The motor 126 may be provided with a sensorless drive for determining the position of the rotor 128, which may also be used by the controller 114 to determine the angular position of the drum 118. For example, certain motors, such as direct drive motors, may provide rotational position information as part of their normal operation. Alternatively, the motor 126 may be provided with a position sensor such as a Hall sensor, for example, for determining the angular position of the drum 118.

The previously described laundry treating appliances 10 and 110 may be used to implement one or more embodiments of a method of the invention. Several embodiments of the method will now be described in terms of the operation of the washing machine 110. While the methods are described with respect to the washing machine 110, the methods may also be used with the laundry treating appliance 10 of the first embodiment of the invention. The embodiments of the method function to automatically determine the amount of laundry in the treating chamber 116. The method is well suited for determining the amount of dry laundry prior to the addition of liquid to the treating chamber 116, unlike many prior art systems that must act on wet laundry to prevent damage to the laundry. As used herein, the amount of the laundry may include one or more characteristics of the laundry including the weight, mass, inertia, volume, diameter, circumference and any other physical dimension.

The amount of laundry may be determined by controlling the motor 126 and the drum 118 to simulate a resonance system having a mass coupled with a spring, with the motor functioning as the spring and the elements driven by the motor, such as the drum and laundry, functioning as the mass. There are other elements that contribute to the "mass", such as the friction of the system coupling the motor to the drum; however, for purposes of this description, the drum and the laundry are the two primary contributors. The frequency of oscillation of a mass coupled with a spring about a predetermined position may be used to determine the size of the mass. In an undamped system, the frequency of oscillation may be correlated to the resonance frequency of the system $f_o$, which is related to the inertia of the system $J_{sys}$, as illustrated in equation (1).

$$J_{sys} = \frac{k_t}{(2\pi f_o)^2} \tag{1}$$

$J_{sys}$ represents the inertia of the system, which in this case is the drum 118 plus the laundry load. The inertia of the load $J_{load}$ may be determined by assuming that $J_{load}$ is equal to $J_{sys}$ minus the inertia of the drum $J_{drum}$. According to equation (1), this yields:

$$J_{load} = \frac{k_t}{(2\pi f_o)^2} - J_{drum} \tag{2}$$

In this manner, the frequency of oscillation $f_o$ of the system and the inertia of the drum $J_{drum}$, may be used to determine the inertia of the load $J_{load}$, which is ultimately related to the amount of laundry within the drum 118. Additional factors, such as damping and friction may also be taken into consideration in determining $J_{load}$.

Figure 4:
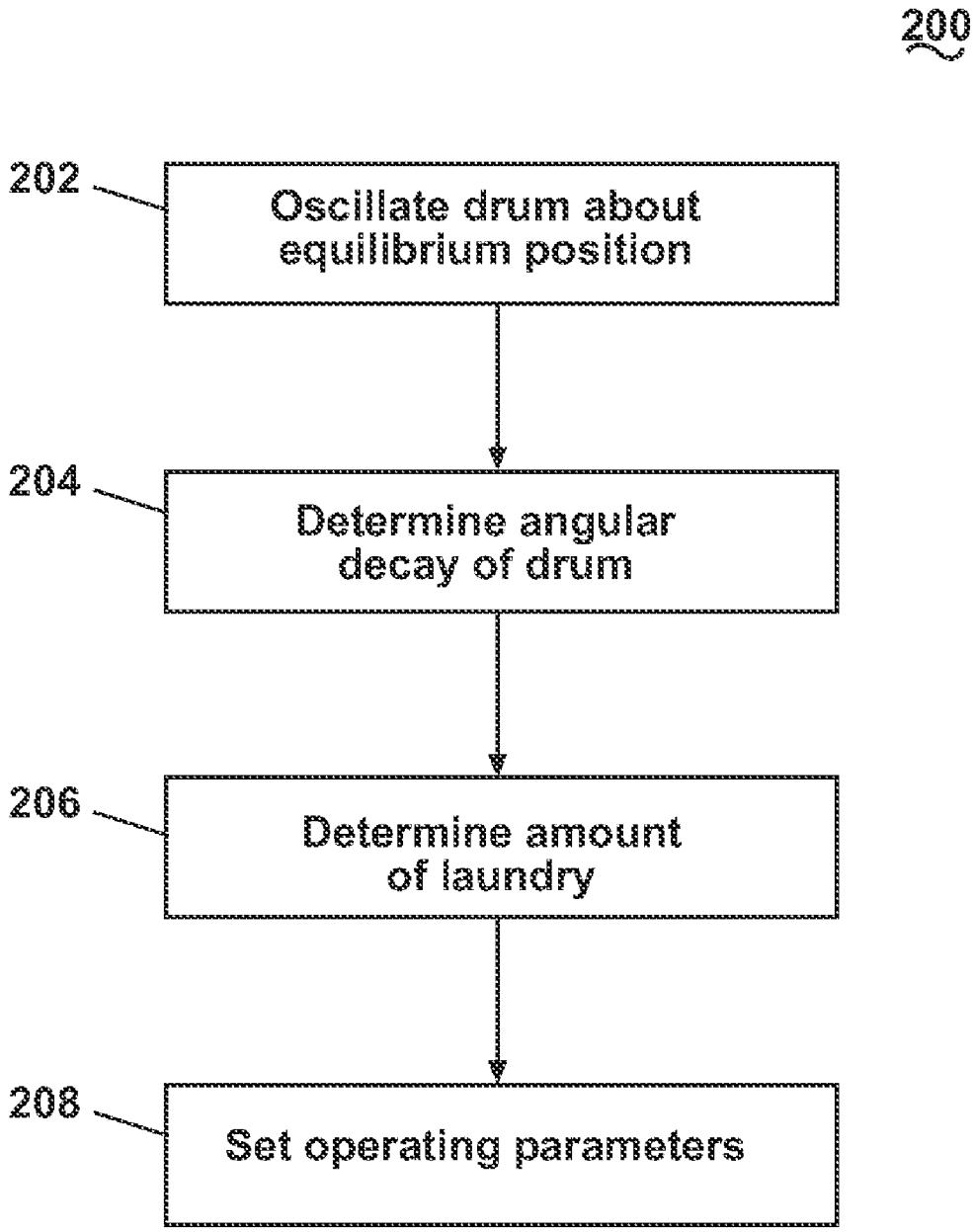
FIG. 4 is a flow chart illustrating a method for determining the amount of laundry within a laundry treating appliance according to a third embodiment of the invention.

Referring now to FIG. 4, a flow chart of one embodiment of a method 200 for determining the amount of laundry is illustrated. The sequence of steps depicted is for illustrative purposes only, and is not meant to limit the method 200 in any way as it is understood that the steps may proceed in a different logical order or additional or intervening steps may be included without detracting from the invention.

The method 200 starts with assuming that the user has placed one or more load items for treatment within the treating chamber 116 and selected a cycle of operation through the user interface 136. The method 200 may be initiated at the beginning of a cycle of operation or prior to the start of a cycle of operation before the addition of liquid to the drum 118. At 202 the controller 114 may drive the motor 126 to oscillate the drum 118 about a predetermined position according to a motor control algorithm stored within the memory 170 of the controller 114. While greater angular displacements are possible, to achieve the goals of the invention, the drum need only be oscillated through relatively small angular displacements, which may by less than plus/minus 180 degrees. At 204 the controller 114 may determine the angular decay of the drum 118 relative to the predetermined position. At 206 the controller 114 may determine the amount of laundry from the angular decay of the drum 118 determined at 204. At 208 the determined amount of laundry may be used to set one or more operating parameters for completing a cycle of operation.

The method 200 may be completed one or more times. If the method 200 is repeated multiple times, the results obtained at 204 or 206 may be weighted, averaged or analyzed in any other beneficial manner and used to determine the amount of laundry and set one or more operating parameters. For example, the method 200 may be completed a plurality of times such that the controller 114 determines an average angular decay at 204 and uses the averaged angular decay value to determine the amount of laundry at 206. Alternatively, the method 200 may be completed such that the amount of laundry may be determined at 206 multiple times and the average amount of laundry may be used by the controller 114 to set one or more operating parameters.

Non-limiting examples of operating parameters that may be set by the controller include an amount of treatment to dispense, an amount of wash liquid to add, a speed and direction of rotation and a number of wash, rinse and spin phases.

Figure 5:
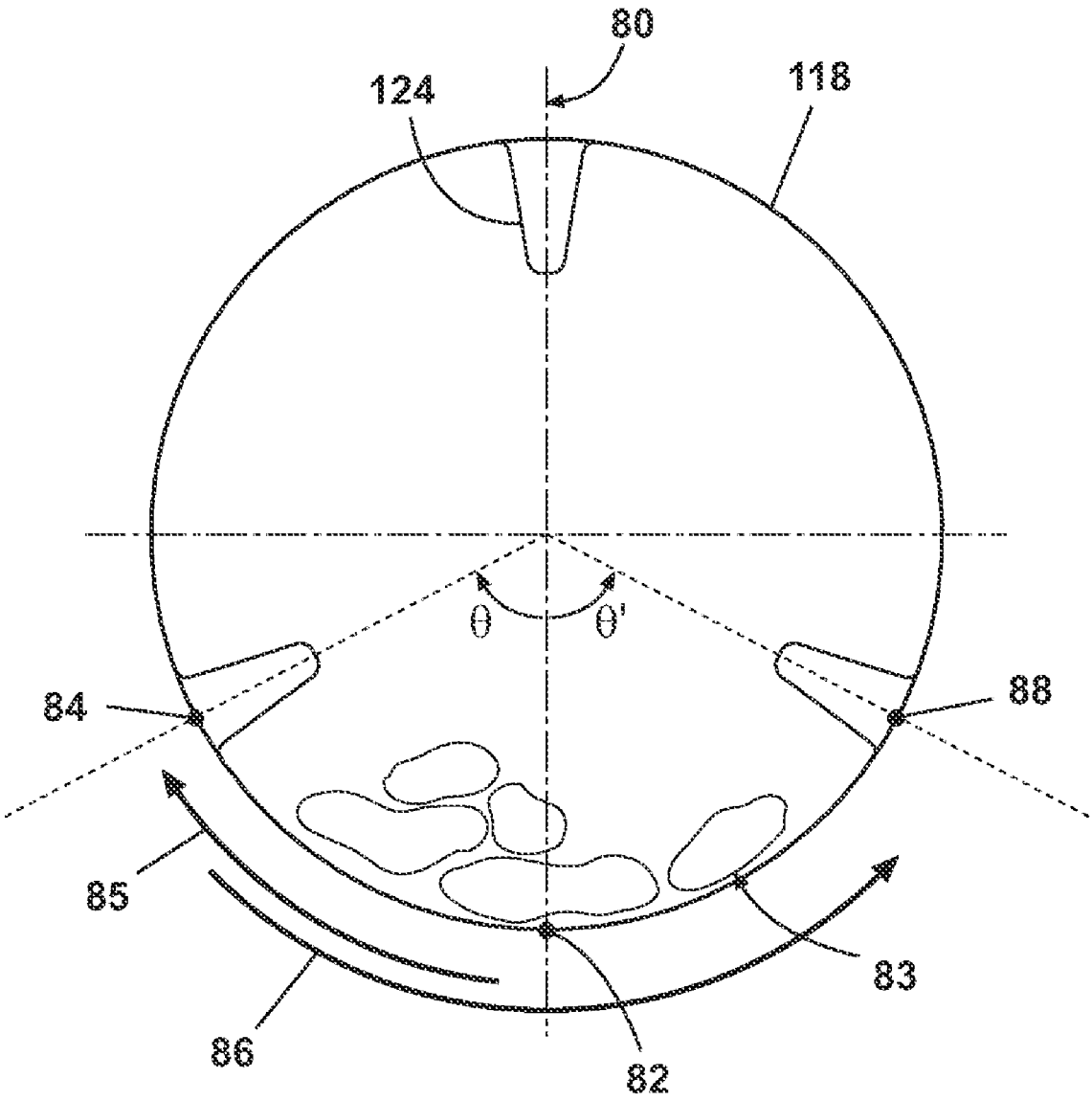
FIG. 5 is schematic representation of a drum oscillating about a predetermined position for determining the amount of laundry according to a fourth embodiment of the invention.

FIG. 5 is a schematic representation of the drum 118 having super-imposed x-y coordinate axes 80 for illustrating the oscillation of the drum 118 about a predetermined position 82 according to 202 of the method 200 illustrated in FIG. 4. The predetermined position may be an equilibrium position defined by the bottom of the drum 118 in its resting position. Alternatively, the predetermined position may be some position offset from the equilibrium position. Prior to the oscillation of the drum 118, load items 83 may generally be located at a bottom of the drum 118 distributed about the equilibrium position 82. At 202 in the method 200, the controller 114 may control the motor 126 to rotate the drum 118 according to the motor control algorithm stored in the memory 170 of the controller 114. The motor control algorithm may include rotating the drum 118 to a first angular displacement position 84 displaced from the equilibrium position 82 by a first angle θ, as illustrated by arrow 85. As illustrated by arrow 86, the motor 126 may then rotate the drum 118 in the opposite direction of the first rotation to a second angular displacement position 88 that is displaced from the equilibrium position 82 by a second angle θ'.

The first angular displacement position 84 may be selected such that the drum 118 is rotated to a position just prior to the point at which the load may start to slip or slide within the treating chamber 116 along an interior surface of the drum 118. This slipping point may vary depending on the amount of laundry, but may generally be considered to be between approximately 15 to 30 degrees. It is also within the scope of the invention for the drum 118 to be rotated to any position relative to the equilibrium position 82 less than 180 degrees.

The motor control algorithm may control the motor 126 to oscillate the drum 118 about the equilibrium position 82 by simulating a spring. The motor 126 may be controlled to simulate a spring by applying a particular torque as a function of the angular displacement position relative to the equilibrium position 82. A torsion spring is a spring that stores mechanical energy when twisted. The torque exerted by the spring is proportional to the torsional stiffness multiplied by the angle of displacement from the equilibrium position. The controller 114 may control the motor 126 to rotate the drum 118 by applying a predetermined torque depending on the angular position of the drum 118 and a predetermined torsional stiffness. In this manner the drum 118 may be controlled to oscillate about the axis of the torsion spring (the drive shaft 130) to simulate a torsional harmonic oscillator. The magnitude of the torsional stiffness and the amount of torque to apply at each angular position may be determined experimentally and saved within the memory 170 of the controller 114.

Figure 6:
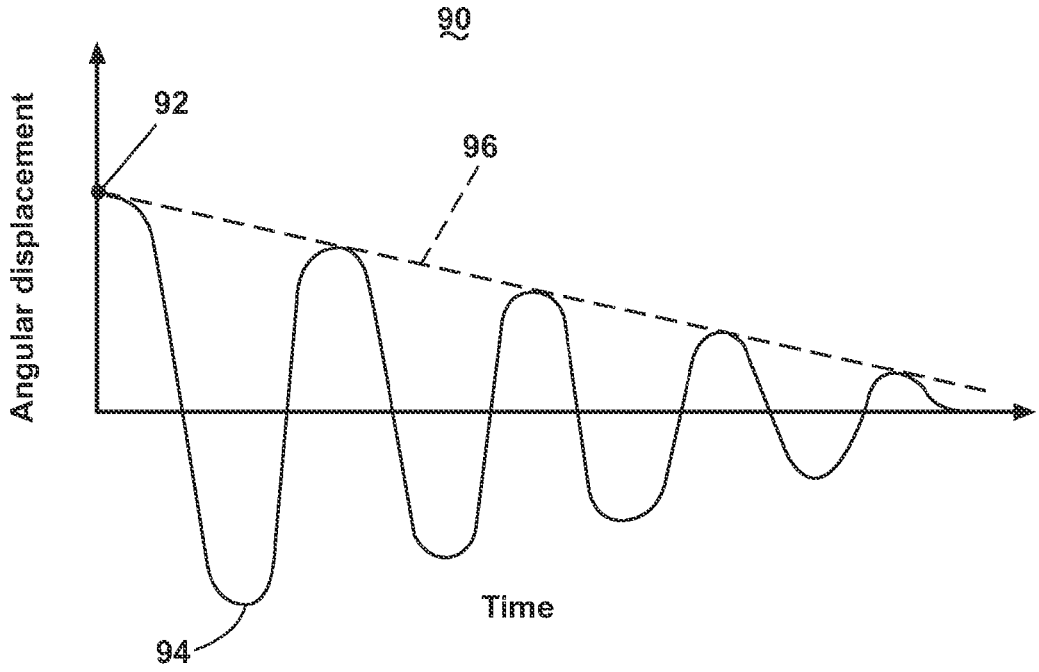
FIG. 6 is a schematic representation of an angular displacement of the drum of FIG. 5 as it is oscillated about a predetermined position according to the fourth embodiment of the invention.

FIG. 6 is a schematic representation 90 of the angular displacement of the drum 118 as it is oscillated relative to the equilibrium position 82 to simulate a spring. FIG. 6 does not represent actual data, but is merely a schematic representation for the purposes of describing the invention. The starting point 92 corresponds to the first angular displacement position 84 represented in FIG. 5. The curve 94 illustrates the change in the angular displacement of the drum 118 over time as the motor 126 is controlled to simulate a spring and oscillate the drum 118 about the equilibrium position 82. This change in angular displacement of the drum 118 over time is proportional to the frequency of oscillation $f_o$ of the system, which, as noted above with respect to equation (2), is related to the amount of laundry. Due to friction in the system, a damping force may be present that may cause the drum 118 containing a load of a given amount to oscillate at some frequency less than the actual resonance frequency of the system. The damping force may also cause the angular displacement of the drum 118 to decay over time, as illustrated by curve 96 in FIG. 6. This angular decay is also proportional to the amount of laundry and may be used by the controller 114 to determine the amount of laundry.

At 204 in the method 200 illustrated in FIG. 4, the controller 114 may be operably coupled with the motor 126 such that it may receive information from the motor 126 regarding the angular position of the drum 118 over time. The controller 114 may use the information regarding the angular position of the drum 118 to determine the angular decay of the drum 118, using software stored in the memory 170 of the controller 114, for example.

The controller 114 may determine the angular decay of the drum 118 over some predetermined period of time. The determined angular decay may then be compared to an angular decay reference value for determining the amount of laundry. Alternatively, the controller 114 may determine the angular decay based on the time it takes for the angular decay to reach a reference angular decay relative to the predetermined position. The time it takes to reach the reference angular decay may then be compared to a reference value for determining the amount of laundry. A plurality of reference angular decay or time values may be determined experimentally and stored in the memory 170 of the controller 114.

At 206 the controller 114 may use the determined angular decay to determine the amount of laundry. This may include comparing the determined angular decay to a reference value stored in the memory 170 of the controller 114. For example, a plurality of reference values may be determined experimentally for a variety of different load amounts and stored in the memory 170 of the controller 114. The reference values may be stored in a look-up table of corresponding load amounts that the controller 114 may consult at 206. The controller 114 may consult the look-up table and determine the amount of laundry based on which reference value the determined angular decay is closest to. In one example, the load amount may be based on the weight of the load, and the look-up table may contain a plurality of reference values corresponding to a specific weight of laundry in kilograms, for example. The controller 114 may then use the determined weight to set one or more operating parameters in completing a cycle of operation.

Alternatively, a plurality of reference values may be determined experimentally and used to generate a function for determining the amount of laundry based on the determined angular decay. The determined angular decay may be plugged into the function and used to generate an output value that corresponds to a load amount.

Figure 7:
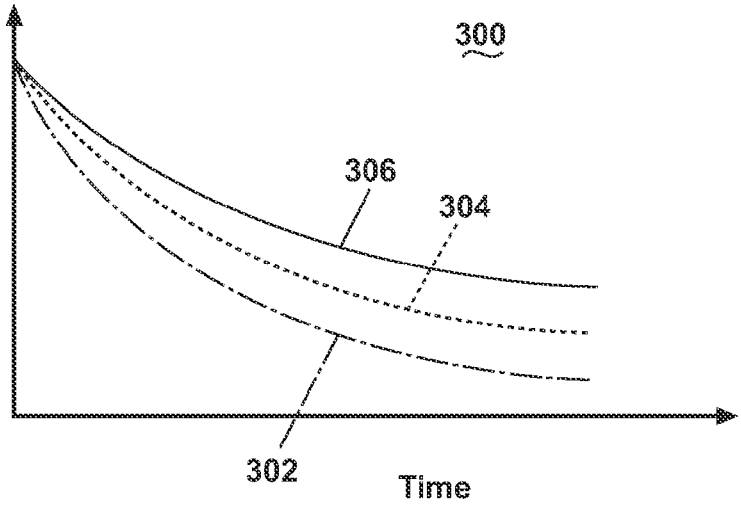
FIG. 7 is a schematic representation of an angular decay of a drum having a small, medium and large laundry load amount according to a fifth embodiment of the invention.

In another example, the look-up table may contain a plurality of reference values that correspond to relative load amounts such as small, medium and large. As illustrated schematically in FIG. 7 by graph 300, the angular decay of the drum 118 over time may vary depending on the amount of laundry. As the amount of laundry increases from small to medium to large, as illustrated by curves 302, 304 and 306 respectively, the rate of angular decay decreases. If the determined angular decay is equal to or less than a reference value corresponding to the small load amount curve 302, the controller may determine that the load amount is small. If the determined angular decay is greater than the reference value corresponding to the small load amount curve 302, but less than or equal to a reference value corresponding to the medium load amount curve 304, the controller 114 may determine that the load amount is medium. If the determined load amount is equal to or greater than a reference value corresponding to the large load amount curve 306, the controller 114 may determine that the load amount is large. The controller 114 may then use the determined small, medium or large load amounts to set one or more operating parameters for completing a cycle of operation.

The method for determining the amount of laundry based on the angular decay of the drum as it is oscillated about the predetermined position provides several advantages over traditional methods for determining load amount. For example, inertial methods for determining the amount of laundry often require the drum to be rotated to high speeds and/or high rates of acceleration/deceleration. These inertial methods may cause damage to the fabrics within the drum. The method described herein does not require such high speeds and/or accelerations and may be much less damaging to fabrics. Additionally, the inertial methods may involve several steps and may take much longer to complete than the oscillation method described above, leading to longer cycle times. Shorter cycle times may provide improved convenience to a user. In addition, because the method is less damaging to fabrics, the amount of laundry may be determined when dry, prior to the addition of water, which may also lead to shorter cycle times and improved convenience.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for determining an amount of laundry in a laundry treating appliance comprising a drum defining a treating chamber for receiving the laundry and a motor for rotating the drum, the method comprising:

operating the motor to simulate a spring to oscillate the drum relative to a predetermined rotational position;

determining an angular decay of the drum relative to the predetermined rotational position; and determining the amount of the laundry based on the determined angular decay.

2. The method according to claim 1 wherein determining the amount of the laundry comprises determining at least one of an inertia, mass and a weight of the laundry.

3. The method according to claim 1 wherein determining the amount of the laundry comprises comparing the determined angular decay to a reference value.

4. The method according to claim 1 wherein determining the amount of the laundry comprises determining a relative amount of the laundry.

5. The method according to claim 4 wherein determining the relative amount of the laundry comprises comparing the determined angular decay against a plurality of reference values corresponding to relative amounts of laundry.

6. The method according to claim 1 wherein determining the angular decay comprises determining the angular decay over a predetermined period of time.

7. The method according to claim 1 wherein determining the angular decay comprises determining a time it takes for the angular decay to reach a reference angular decay relative to the predetermined rotational position.

8. The method according to claim 1, wherein operating the motor to simulate a spring comprises operating the motor to simulate a torsional spring.

9. The method according to claim 1, further comprising rotating the drum to an angular position spaced from the predetermined rotational position prior to operating the motor to simulate a spring.

10. A laundry treating appliance comprising:

a drum defining a treating chamber for receiving laundry and rotatable about an axis of rotation;

a motor operably coupled to the drum to rotate the drum about the axis of rotation; and a controller coupled to the motor and configured to have a motor control algorithm operable to control the motor to simulate a spring to oscillate the drum relative to a predetermined position.

11. The laundry treating appliance according to claim 10, further comprising a position sensor operably coupled to the controller and configured to provide a signal to the controller indicative of an angular position of the drum relative to the predetermined position.

12. The laundry treating appliance according to claim 11 wherein the controller further comprises a clock providing a time signal to the controller and the controller is configured to monitor at least one of a decay in the angular position over a predetermined period of time and a time for the drum to decay to a predetermined angular position.

13. The laundry treating appliance according to claim 10 wherein the motor comprises a stator and a rotor, which is operably coupled to the drum, and which is configured to output a signal indicative of an angular position of the rotor relative to the stator to form a position sensor.

14. The laundry treating appliance according to claim 10 wherein the motor control algorithm is configured to simulate a torsion spring.

15. The laundry treating appliance according to claim 10 wherein the controller includes a memory in which are stored reference values corresponding to relative amounts of laundry.

16. The laundry treating appliance according to claim 15 wherein the stored reference values are indicative of at least one of a decay in an angular position of the drum relative to the predetermined position over a predetermined period of time and a time for the drum to decay to a predetermined angular position.

* * * * *